US010099233B2

(12) United States Patent
Tsai

(10) Patent No.: US 10,099,233 B2
(45) Date of Patent: Oct. 16, 2018

(54) COSMETIC AIR BRUSH

(71) Applicant: Dah Cherng Stationery Co., Ltd., Tainan (TW)

(72) Inventor: Ming-Chun Tsai, Tainan (TW)

(73) Assignee: Dah Cherng Stationery Co., Ltd., Tainan (TW)

( * ) Notice: Subject to any disclaimer, the term of this patent is extended or adjusted under 35 U.S.C. 154(b) by 0 days.

(21) Appl. No.: 15/359,191

(22) Filed: Nov. 22, 2016

(65) Prior Publication Data

US 2018/0141063 A1 May 24, 2018

(51) Int. Cl.

| | |
|---|---|
| ***B05B 7/24*** | (2006.01) |
| ***A45D 33/02*** | (2006.01) |
| ***A45D 34/04*** | (2006.01) |
| ***B05B 12/00*** | (2018.01) |

(52) U.S. Cl.

CPC ..... *B05B 7/2405* (2013.01); *A45D 33/02* (2013.01); *A45D 34/04* (2013.01); *B05B 7/2489* (2013.01); *B05B 12/002* (2013.01)

(58) Field of Classification Search

CPC ... B05B 7/2402; B05B 7/2405; B05B 7/2408; B05B 7/2429; B05B 7/2435; B05B 7/2489; B05B 12/002; A45D 33/02; A45D 34/04

See application file for complete search history.

(56) References Cited

U.S. PATENT DOCUMENTS 1,501,432 A 7/1924 Bleakley
1,638,550 A * 8/1927 Paasche ..... B05B 7/2429 239/346
1,703,359 A * 2/1929 Paasche ..... B05B 7/1209 239/346
4,020,990 A * 5/1977 Luff ..... B05B 7/12 239/346
4,023,524 A * 5/1977 Goldfarb ..... A63H 33/22 101/114
4,606,501 A 8/1986 Bate et al.
(Continued)

FOREIGN PATENT DOCUMENTS

FR 882 833 6/1943
WO WO 2017/129750 8/2017

OTHER PUBLICATIONS

Extended European Search Report dated Jul. 16, 2018, by the European Patent Office, in related European Patent Application No. 18150486.1, filed Jan. 5, 2018, 9 pp.

*Primary Examiner* — Darren W Gorman
(74) *Attorney, Agent, or Firm* — Klarquist Sparkman, LLP

(57) ABSTRACT

A media applicator includes an airbrush body couplable to a reservoir and defining a passage for conducting a gas, and a spray head couplable to the airbrush body. The spray head has a nozzle portion in fluid communication with a media tube extending into the reservoir, the nozzle portion defining a lumen in fluid communication with the passage when the spray head is coupled to the airbrush body. The nozzle portion further includes a discharge tube in fluid communication with the media tube, and situated such that gas flow from the passage through the lumen draws a media contained in the reservoir through the media tube into the discharge tube, and from the discharge tube into a flow of gas exiting the lumen of the nozzle portion. The spray head is detachable from the airbrush body to allow the nozzle portion to be carried away with the spray head.

20 Claims, 11 Drawing Sheets

(56) References Cited

U.S. PATENT DOCUMENTS

| | | | | | |
|---|---|---|---|---|---|
| 5,255,852 | A * | 10/1993 | Morrison | B05B 7/2429 | 239/346 |
| 5,346,135 | A * | 9/1994 | Vincent | B05B 7/2429 | 239/306 |
| 5,366,158 | A * | 11/1994 | Robisch | B05B 7/2435 | 239/289 |
| 5,421,518 | A * | 6/1995 | Robisch | B05B 7/064 | 239/311 |
| 5,454,517 | A | 10/1995 | Naemura | | |
| 6,341,736 | B1 * | 1/2002 | Liao | B05B 7/2429 | 239/306 |
| 6,354,517 | B1 * | 3/2002 | Wu | B05B 7/1209 | 239/353 |
| 6,425,536 | B2 | 7/2002 | Naemura | | |
| 7,070,124 | B1 * | 7/2006 | Juo | B05B 7/064 | 239/340 |
| 7,152,813 | B2 | 12/2006 | Chen | | |
| 7,246,757 | B2 * | 7/2007 | Juo | B05B 7/2435 | 239/288 |
| 2004/0217198 | A1 * | 11/2004 | Lloyd | B05B 7/2416 | 239/306 |
| 2014/0252127 | A1 * | 9/2014 | Fedorov | B05B 7/2424 | 239/305 |

* cited by examiner

COSMETIC AIR BRUSH

FIELD

The present application concerns embodiments of nozzles and spray heads for air brushes.

BACKGROUND

Media applicators, such as airbrushes, are useful for applying media such as paint, powder, cosmetic products, etc., evenly to a surface or substrate. However, due to the narrow passages, relatively high gas flow velocity, and the volatile nature of many media, the nozzles of media applicators are prone to clogging. Thus, media applicators must be periodically cleaned or replaced. Cleaning and unclogging media applicators can be time-consuming, and results in lost productivity. Additionally, typical media applicators must be cleaned before the media applicator can be used to apply a different color or type of media. Replaceable media applicators also often require that the entire airbrush body be replaced, sometimes together with the media reservoir containing the media to be applied, resulting in waste of media and increased expense. Accordingly, a need exists for improved media applicators.

SUMMARY

Certain embodiments of the disclosure concern media applicators with removable spray heads. In a representative embodiment, a media applicator comprises an airbrush body couplable to a media reservoir and defining a first passage for conducting a pressurized gas, and a spray head couplable to the airbrush body. The spray head comprises a nozzle portion in fluid communication with a media tube extending into the media reservoir, the nozzle portion defining a lumen configured to be in fluid communication with the first passage when the spray head is coupled to the airbrush body. The nozzle portion further includes a discharge tube in fluid communication with the media tube and situated such that pressurized gas flow from the first passage through the lumen draws a media contained in the media reservoir through the media tube into the discharge tube, and from the discharge tube into a flow of pressurized gas exiting the lumen of the nozzle portion. The spray head is detachable from the airbrush body to allow the nozzle portion to be carried away with the spray head without detaching the airbrush body from the media reservoir.

In another representative embodiment, a method comprises coupling a spray head to an airbrush body. The airbrush body is coupled to a media reservoir and defines a first passage for conducting a pressurized gas. The spray head comprises a nozzle portion in fluid communication with a media tube extending into the media reservoir, and the nozzle portion defines a lumen configured to be in fluid communication with the first passage when the spray head is coupled to the airbrush body. The nozzle portion further includes a discharge tube in fluid communication with the media tube and situated such that pressurized gas flow from the first passage through the lumen draws a media contained in the media reservoir through the media tube into the discharge tube, and from the discharge tube into a flow of pressurized gas exiting the lumen of the nozzle portion. The method further includes activating a trigger portion of the airbrush body such that pressurized gas flows from the first passage into the lumen of the nozzle portion, and media from the media reservoir is introduced from the discharge tube into a flow of pressurized gas exiting the lumen of the nozzle portion and directed outwardly from the nozzle portion.

The foregoing and other objects, features, and advantages of the disclosed technology will become more apparent from the following detailed description, which proceeds with reference to the accompanying figures.

DETAILED DESCRIPTION

First Representative Embodiment

Figure 1:
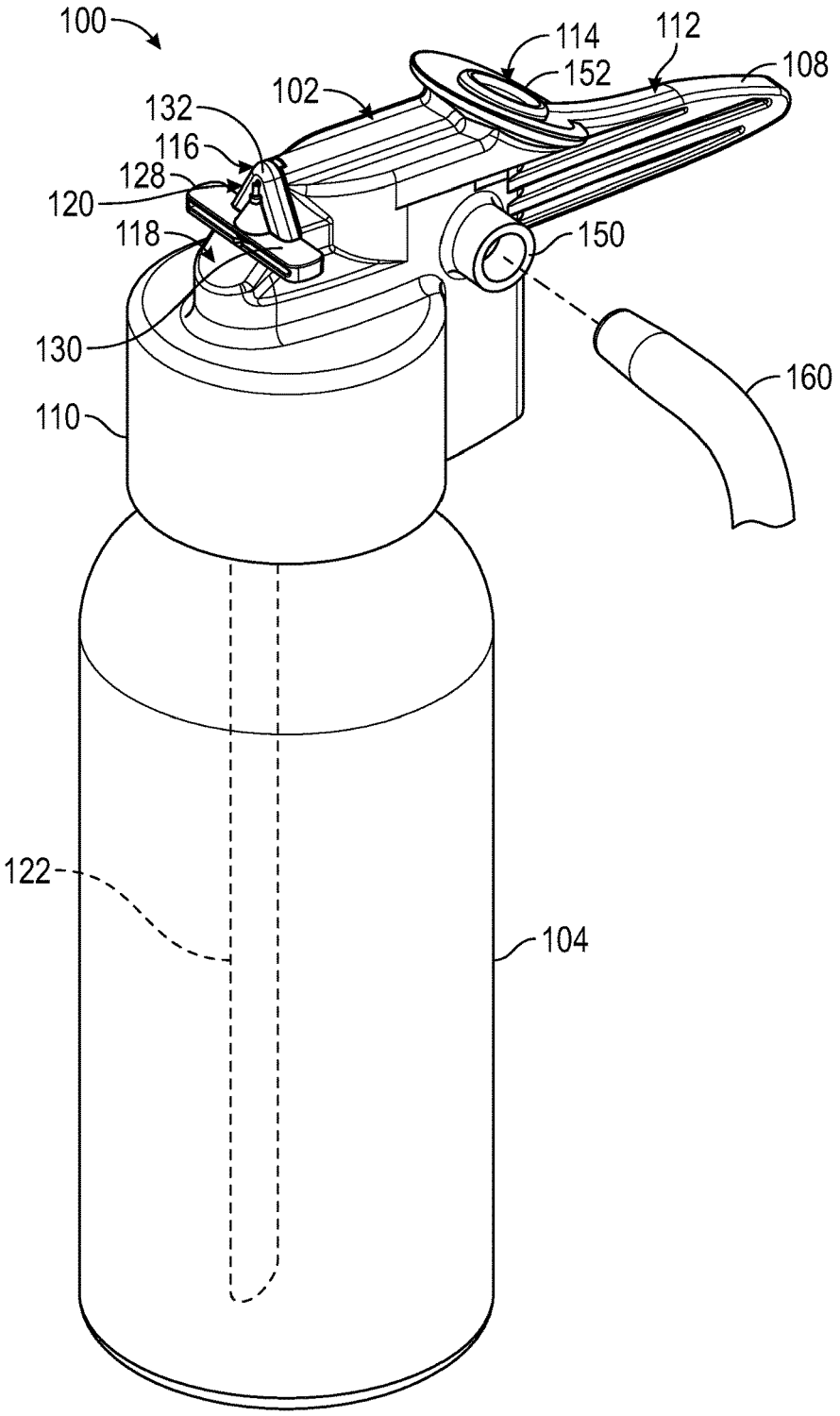
FIG. 1 is a perspective view of a representative embodiment of media applicator configured as an airbrush including an airbrush body coupled to a media reservoir, and a removable spray head coupled to the airbrush body.

FIG. 1 illustrates a representative embodiment of a media applicator configured as an airbrush 100 including an airbrush body 102 coupled to a media reservoir 104. In the illustrated configuration, the media reservoir 104 is configured as a bottle that contains media 106 (see FIGS. 3 and 4) to be applied to a target substrate by the airbrush 100. The media 106 can be a liquid media such as paint, a liquid cosmetic, etc., or a dry media, such as a powder. The airbrush 100 can be configured to mix the media 106 from a discharge tube 136 (FIG. 2) with compressed gas from a lumen 142 situated adjacent and at an angle to the discharge tube in a manner generally associated with an "external mix" airbrush.

The airbrush body 102 can include a handle portion 108 and a coupling portion 110 configured to engage the media reservoir 104. In some examples, the coupling portion 110 can include threads on an interior surface of the mounting portion configured to engage corresponding threads on the upper portion of the media reservoir such that the airbrush body 102 and the media reservoir 104 can be secured to each other in threaded engagement. The handle portion 108 of the airbrush body 102 can include a grip portion 112 by which a user can grip the airbrush body, and a trigger portion 114. Activation of the trigger portion 114 by a user can cause the airbrush 100 to discharge a flow of media toward a target substrate, as further described below.

Figure 2:
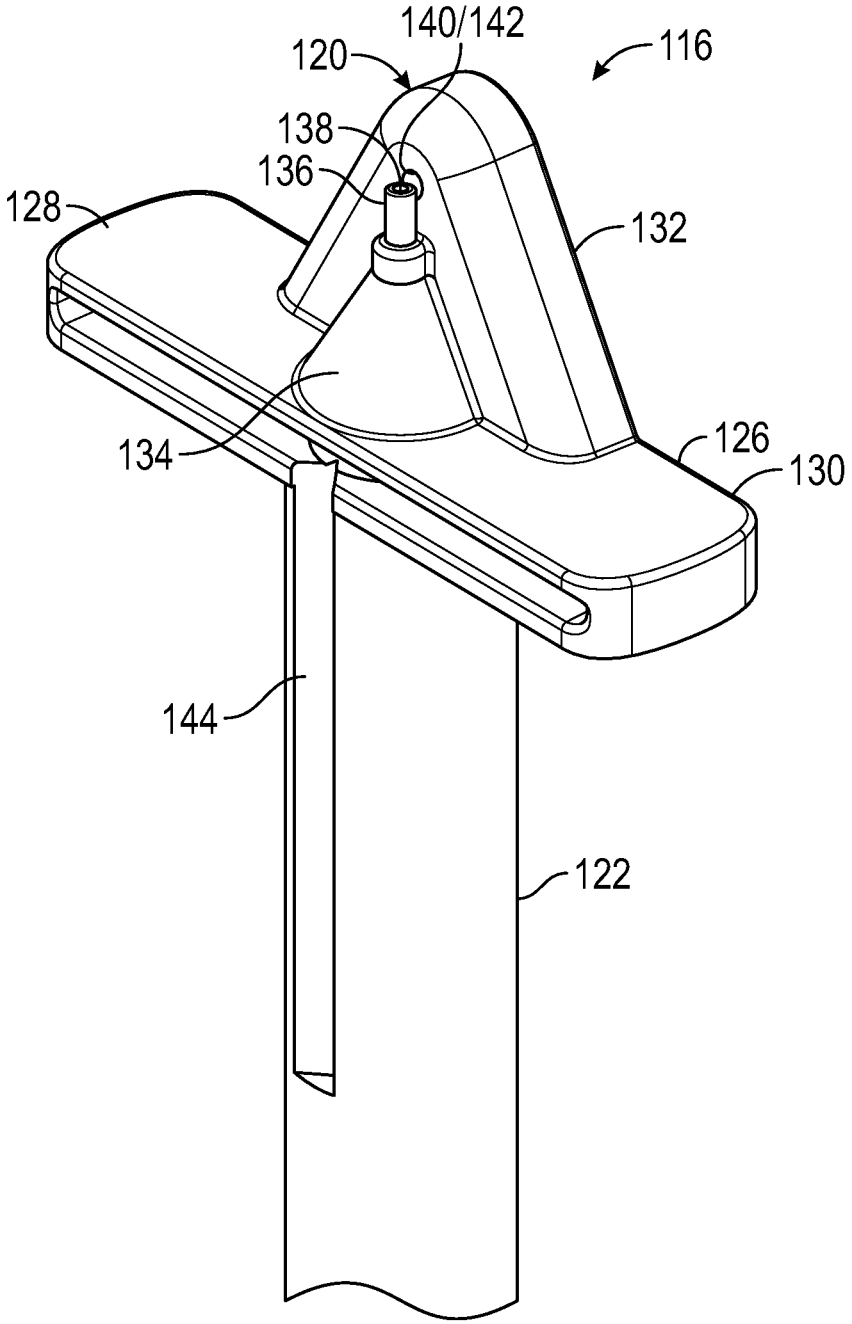
FIG. 2 is a perspective view of an upper portion of the removable spray head of FIG. 1.

Referring to FIGS. 1 and 2, the airbrush can further comprise a removable spray head 116, which can be situated on a mounting portion 118 of the airbrush body 102. The spray head 116 can include a nozzle portion 120 and a media tube 122 coupled to and in fluid communication with the nozzle portion 120. As shown in FIG. 1, when the spray head 116 is situated on the airbrush body 102, the nozzle portion 120 can be located on the mounting portion 118 on the outside of the airbrush body, and the media tube 122 can extend into the media reservoir 104 through an opening 124 defined in the airbrush body (see, e.g., FIG. 5). The media tube 122 and the nozzle portion 120 of the spray head 116 can be integrally formed with one another such that the spray head 116 is a unitary construction. As used herein, the terms "integrally formed" and "unitary construction" refer to a construction that does not include any welds, fasteners, or other means for securing separately formed pieces of material to each other. Alternatively, the nozzle portion and the media tube can be separately formed and coupled to one another by, for example, suitable coupling mechanisms, adhesive, press-fit, etc.

FIG. 2 illustrates the nozzle portion 120 in greater detail. The nozzle portion 120 can include a base portion 126 having first and second tab portions 128, 130, and a head portion 132. A cone-shaped support 134 can be located adjacent the head portion 132 and can define an opening in which the media discharge tube 136 is received. The discharge tube 136 can be situated such that an outlet 138 of the discharge tube is positioned adjacent an outlet 140 of the lumen 142 defined in the head portion 132. In the illustrated embodiment, the outlet 138 of the discharge tube 136 and the outlet 140 of the lumen 142 are oriented at an angle of about 90 degrees to each other, although other angles are possible (e.g., between about 45 degrees to about 90 degrees). The spray head 116 can also include a vent channel 144 defined in the base portion 126 and extending along at least a portion of the media tube 122.

Figure 3:
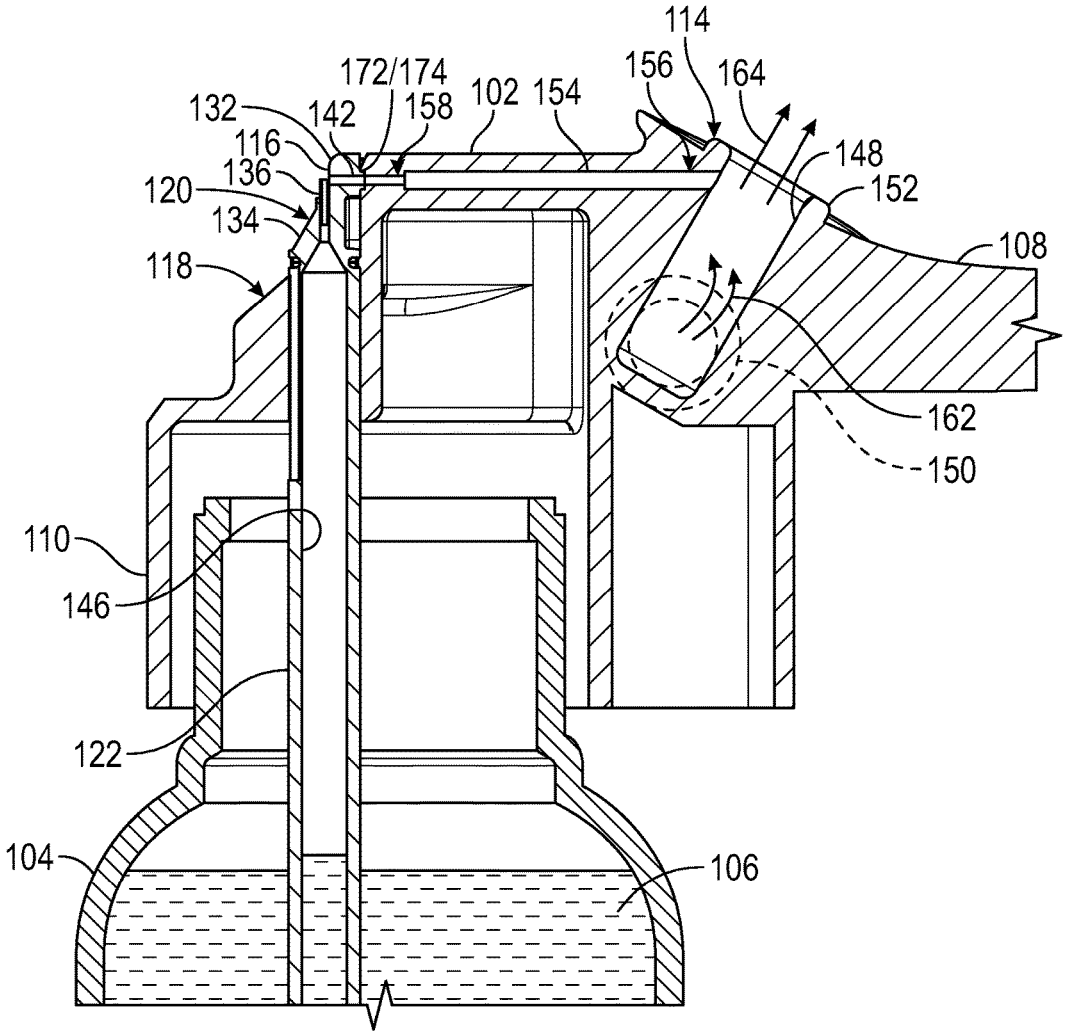
FIG. 3 is a cross-sectional side elevation view of the airbrush of FIG. 1 illustrating flow of compressed gas from in inlet of the airbrush body through an outlet of a trigger portion.
Figure 4:
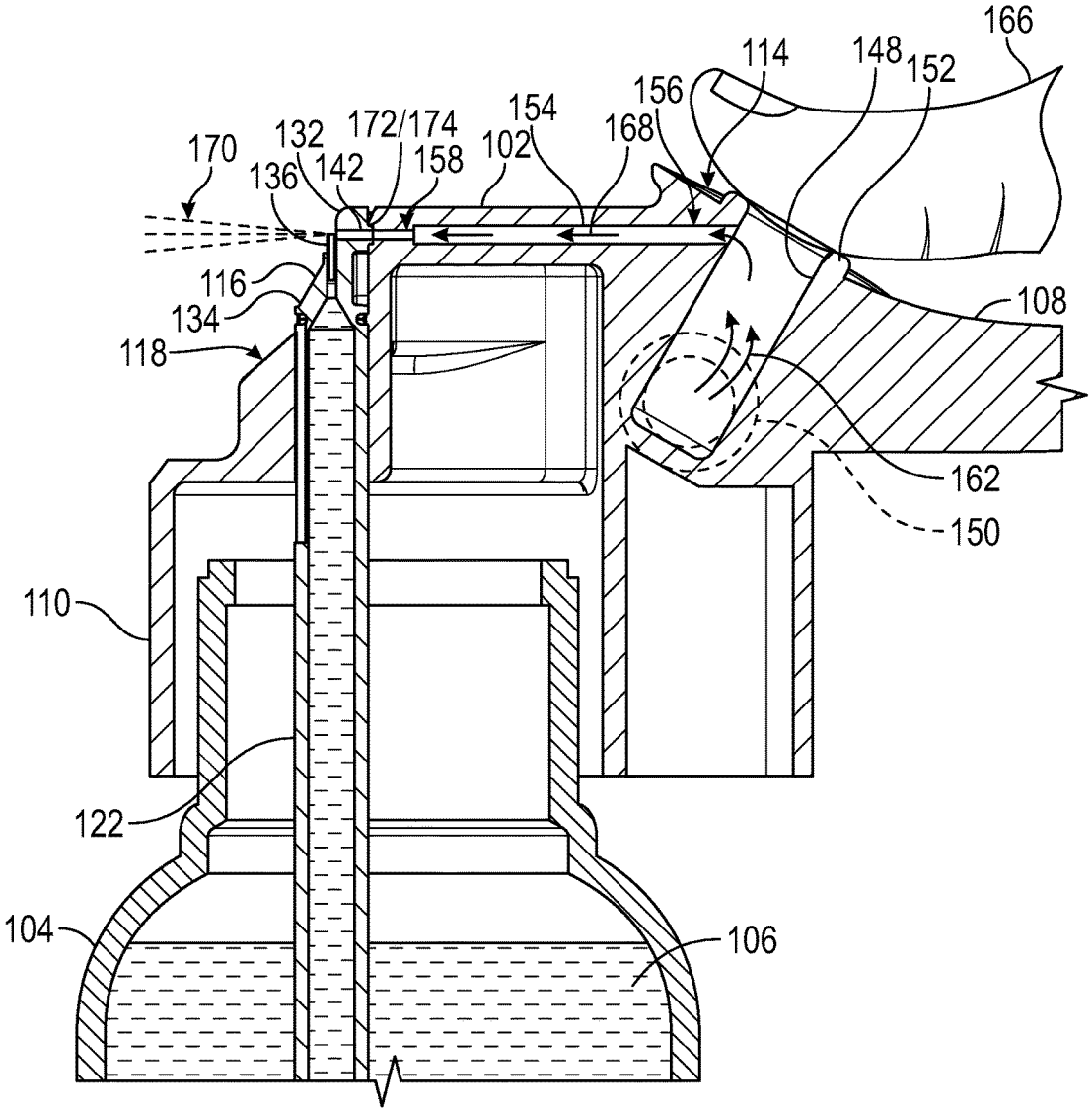
FIG. 4 is a cross-sectional side elevation view of the airbrush body and removable spray head of FIG. 1 illustrating flow of compressed gas through the removable spray head to produce a flow of media.

FIGS. 3 and 4 are cross-sectional views of the airbrush body 102 and spray head 116. As shown in FIGS. 3 and 4, a primary lumen 146 of the media tube 122 can be in fluid communication with the discharge tube 136 situated in the support 134 such that media 106 can flow from the media reservoir, through the media tube, and into the discharge tube 136 when the trigger 114 is activated.

The airbrush body 102 can also define one or more passages in fluid communication with the lumen 142. For example, in the illustrated configuration, the airbrush body 102 can define a first passage 148 located adjacent the handle portion 108 of the airbrush body. The passage 148 can be in fluid communication with an inlet port 150 (see FIG. 1), and with an outlet port 152 defined by the trigger portion 114. The airbrush body can further define a second passage 154 in fluid communication with the first passage 148, and including an inflow end 156 and an outflow end 158. As shown in FIGS. 3 and 4, the inflow end 156 of the second passage 154 can be in fluid communication with the first passage 148, while the outflow end 158 of the second passage can be in fluid communication with the lumen 142 of the spray head 116 when the spray head is coupled to the airbrush body. In the illustrated embodiment, the outflow end 158 of the second passage 154 can have a smaller diameter than the intermediate portion of the second passage in order to increase the velocity of the compressed gas passing through the outflow end into the lumen 142.

In the illustrated configuration, the spray head 116 can be retained on the airbrush body 102 by a coupling mechanism configured as a protruding portion or protuberance 172 defined on a rear surface of the head portion 132. In the illustrated configuration, the protuberance 172 can be annular, and can surround the inflow orifice of the lumen 142. When the spray head 116 is situated on the mounting portion 118, the protuberance 172 can be received in a corresponding recess 174 defined in the opposing surface of the airbrush body, as best shown in FIGS. 3 and 4. In this manner, the protuberance 172 and the recess 174 can serve to maintain a precise alignment between the lumen 142 and the second passage 154 during use.

Operation of the airbrush can proceed as follows. Compressed gas (e.g., air) can be received in the airbrush body through the inlet 150 from a compressed gas source configured as a hose 160 illustrated in FIG. 1. Referring to FIG. 3, when the outlet port 152 of the trigger portion 114 is uncovered, compressed gas can flow from the inlet 150 into the first passage 148, as indicated by arrows 162, and can exit the airbrush body through the outlet port 152 as indicated by arrows 164. In this scenario, no media flow is produced. Referring to FIG. 4, when the trigger portion 114 is activated by, for example, a user covering the outlet port 152 with a finger 166, compressed gas can flow from the first passage 148 into the second passage 154, as indicated by arrows 168, and from the second passage into the lumen 142 of the spray head 116 after accelerating through the narrow outflow end 158 of the second passage.

As compressed gas exits the lumen 142, it can pass over and/or around the outlet 138 of the discharge tube 136. This gas flow across the outlet 138 can produce a decrease in pressure in the discharge tube 136 according to Bernoulli's Principle, causing media 106 to be drawn from the reservoir through the lumen 146 and introduced into the gas flow from the discharge tube 136 as atomized media flow 170, as shown in FIG. 4. The trigger 114 can be repeatedly activated and deactivated as desired to apply media to a substrate. Air can be drawn into the media reservoir 104 through the vent channel 144 to equalize the pressure in the media reservoir as media 106 is discharged from the spray head 116.

Figure 5:
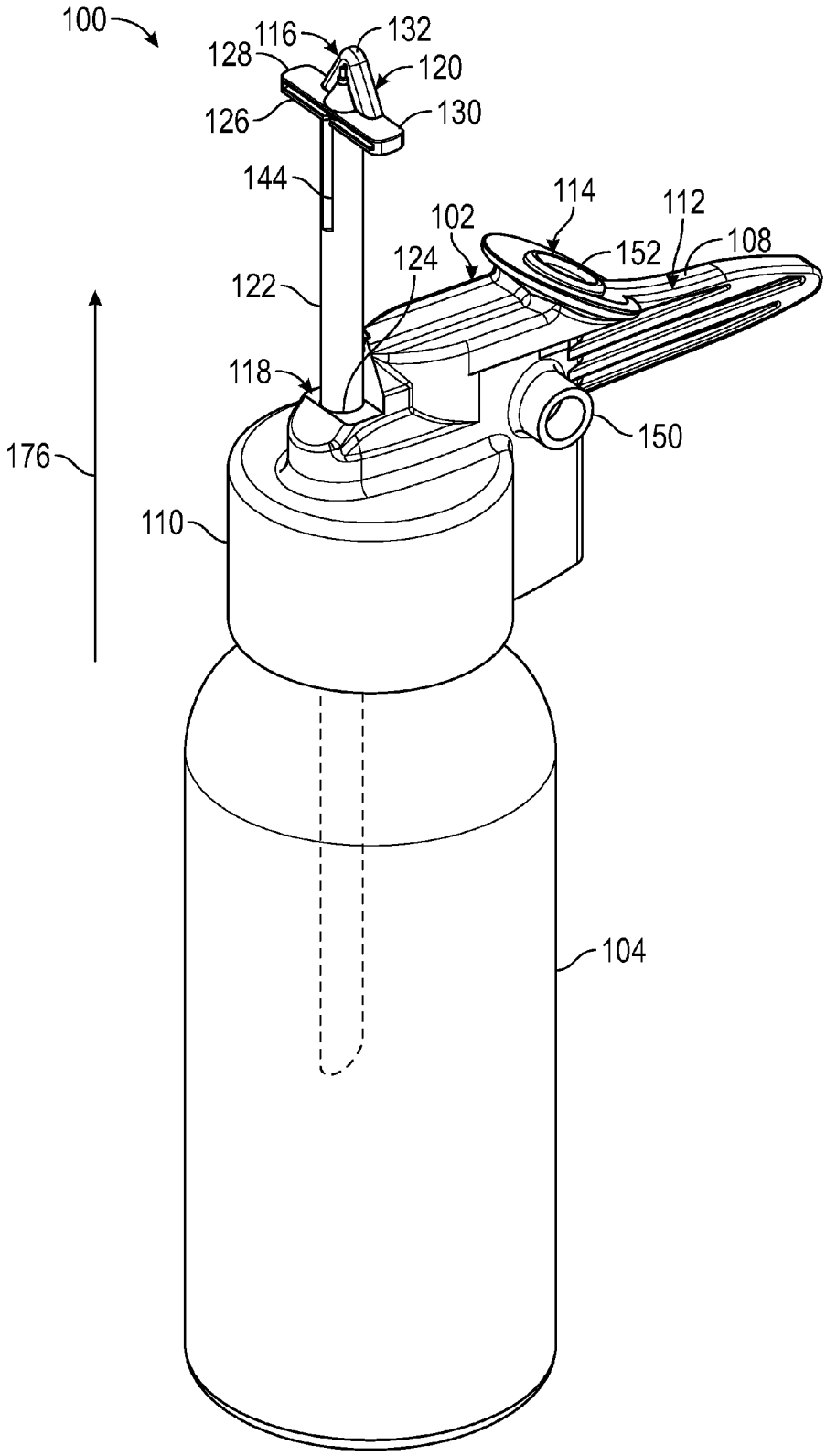
FIG. 5 is a perspective view of the airbrush of FIG. 1 illustrating removal of the removable spray head from the airbrush body.
Figure 6:
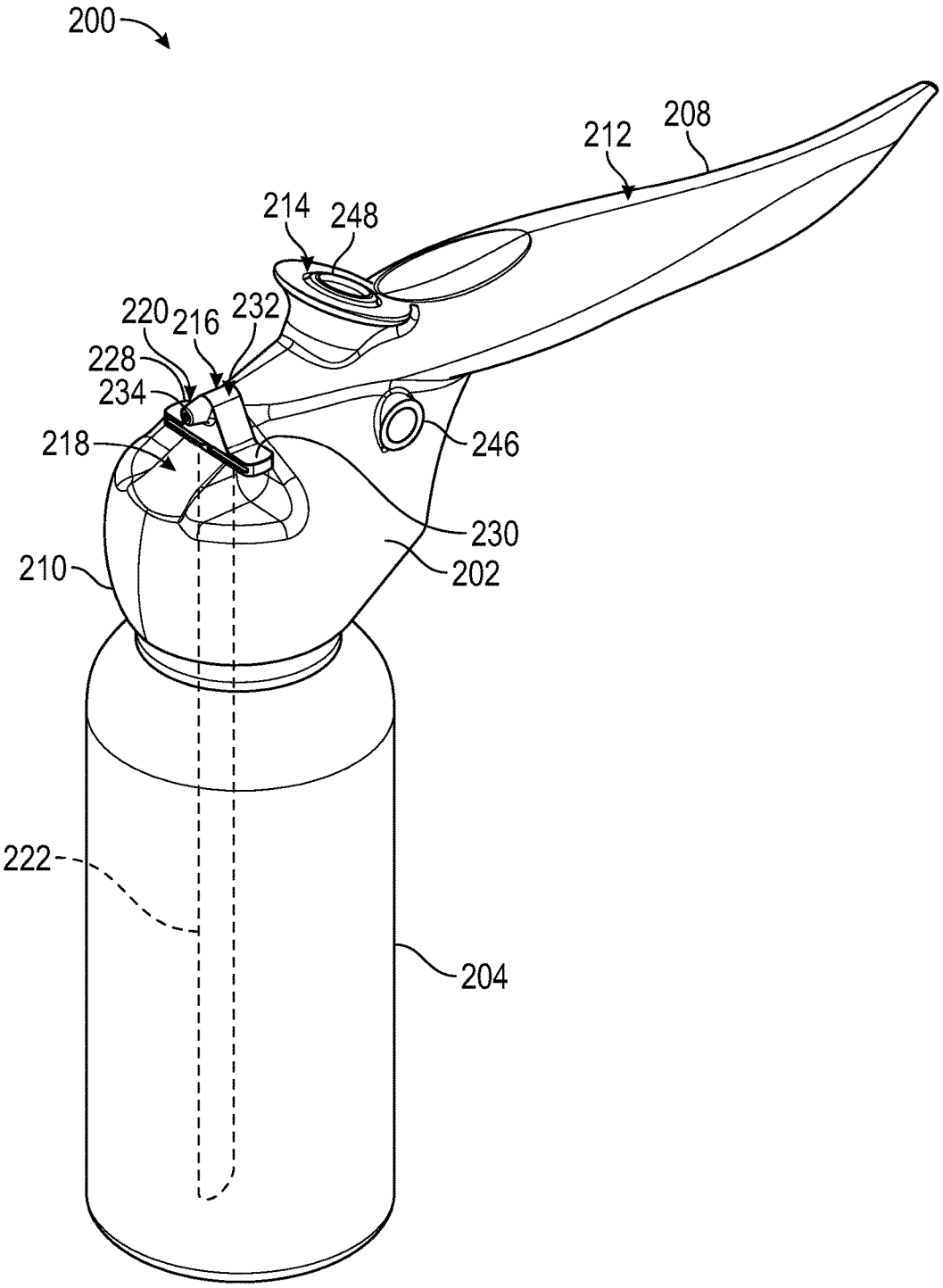
FIG. 6 is a perspective view of another embodiment of an airbrush including an airbrush body coupled to a media reservoir and a removable spray head coupled to the airbrush body.

When a desired amount of media has been applied to the substrate, or if a portion of the spray head 116 becomes clogged (e.g., discharge tube 136), the spray head 116 can be removed from the airbrush body 102 and the media reservoir 104, as illustrated in FIG. 5. For example, in the illustrated configuration, a user can grip the tab portions 128, 130 of the base 126 and pull the spray head upwardly in the direction of arrow 176 such that the protuberance 172 disengages from the recess 174 to uncouple the nozzle portion 120 from the airbrush body 102 while the media tube 122 is drawn out of the reservoir 104 through the opening 124. This allows the spray head 116 to be easily detached from the airbrush body without requiring the airbrush body to be disconnected from the media reservoir or from the compressed gas source 160. A clean replacement spray head can then be coupled to the airbrush by inserting the media tube 122 into the reservoir and situating the nozzle portion 120 on the mounting portion 118 such that the protuberance 172 engages the recess 174. Application of media to the substrate can then be resumed.

Second Representative Embodiment

FIGS. 6-12 illustrate another embodiment of a media applicator configured as an airbrush 200 and adapted to mix a media supplied from a discharge tube with a flow of compressed gas produced coaxially around the discharge tube in a manner generally associated with an "internal mix" airbrush. The airbrush 200 can comprise an airbrush body 202 coupled to a media reservoir 204 containing a media 206 (e.g., a liquid media or a dry or powdered media) (see FIGS. 10 and 11). The airbrush body 202 can include a handle portion 208 and a coupling portion 210 configured to engage the media reservoir 204 by, for example, complementary threads, similar to the embodiment of FIGS. 1-5 above. The handle portion 208 can include a grip portion 212 and a trigger portion 214. A removable spray head 216 can be situated on a mounting portion 218 of the airbrush body and oriented to project a flow media toward a target substrate, similar to the media applicator 100 described above.

Figure 7:
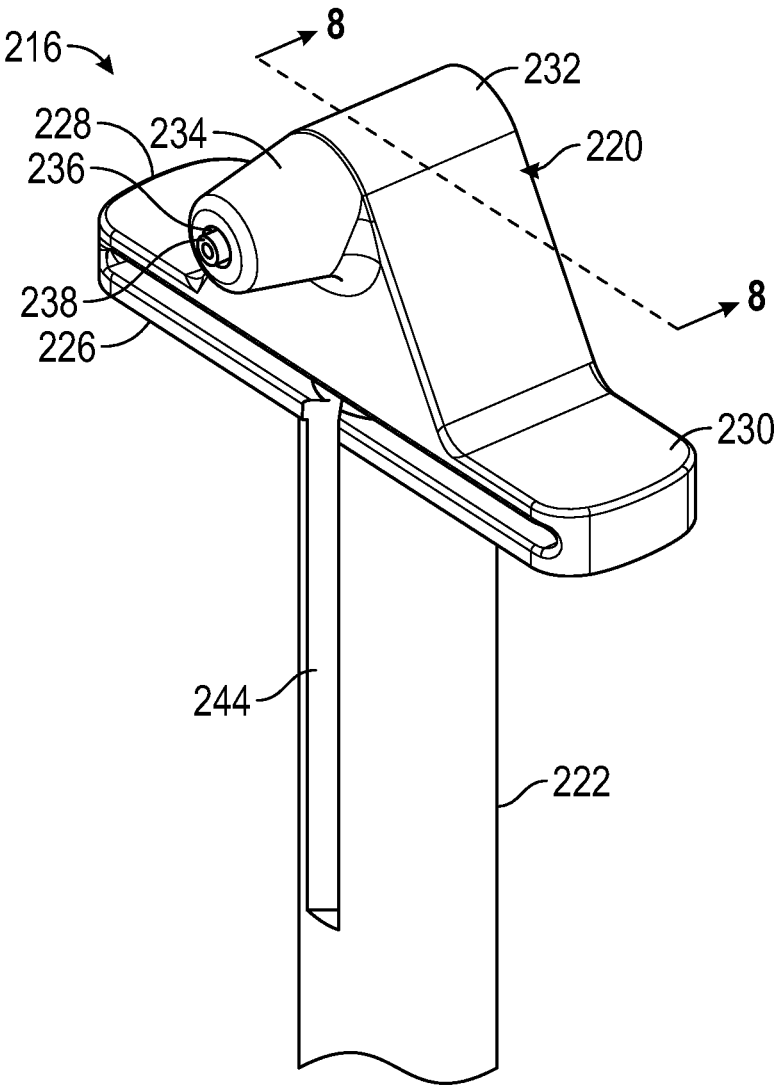
FIG. 7 is a perspective view of an upper portion of the removable spray head of FIG. 6.

FIG. 7 illustrates the upper portion of the spray head 216 in greater detail. The spray head 216 can include a nozzle portion 220 and a media tube 222 coupled to the nozzle portion and extending into the media reservoir 204 through an opening 224 defined in the airbrush body (see FIG. 12). The nozzle portion 220 can include a base portion 226 having first and second tab portions 228, 230 similar to the embodiment described above, and a head portion 232. The head portion 232 can include an air cap portion 234 (also referred to as a crown cap portion) with a longitudinal axis oriented perpendicular to a longitudinal axis of the media tube 222. The head portion 232 and the air cap portion 234 can define a lumen 236 with a discharge tube 238 situated therein. The spray head 216 can also define a vent channel 244 extending from the base 226 along at least a portion of the length of the media tube 222.

Figure 8:
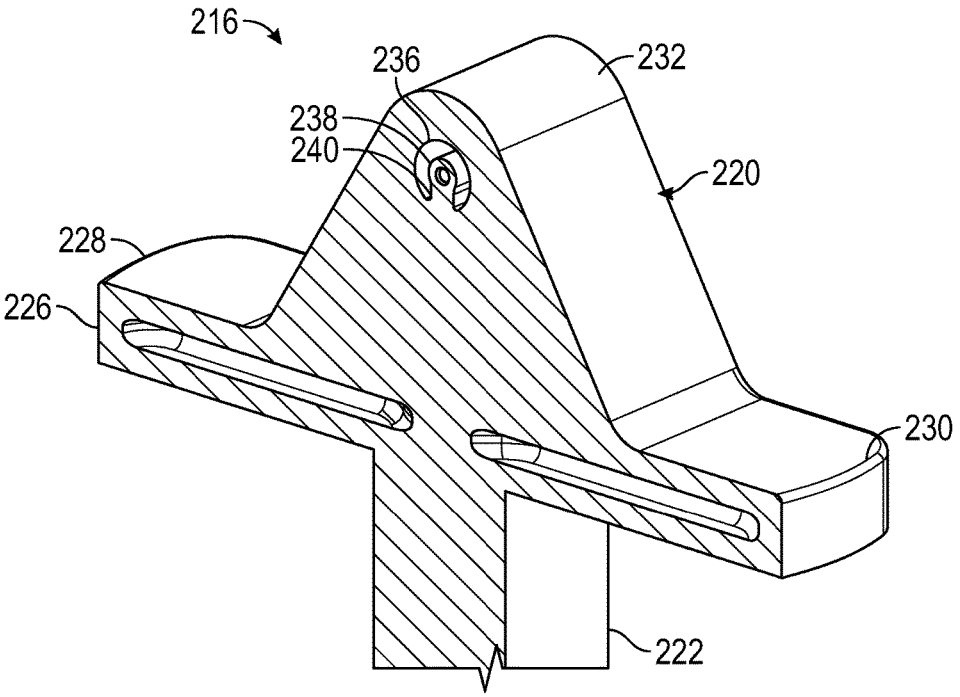
FIG. 8 is a cross-sectional perspective view of the nozzle portion of the removable spray head of FIG. 1 taken along line 8-8 of FIG. 7.
Figure 9:
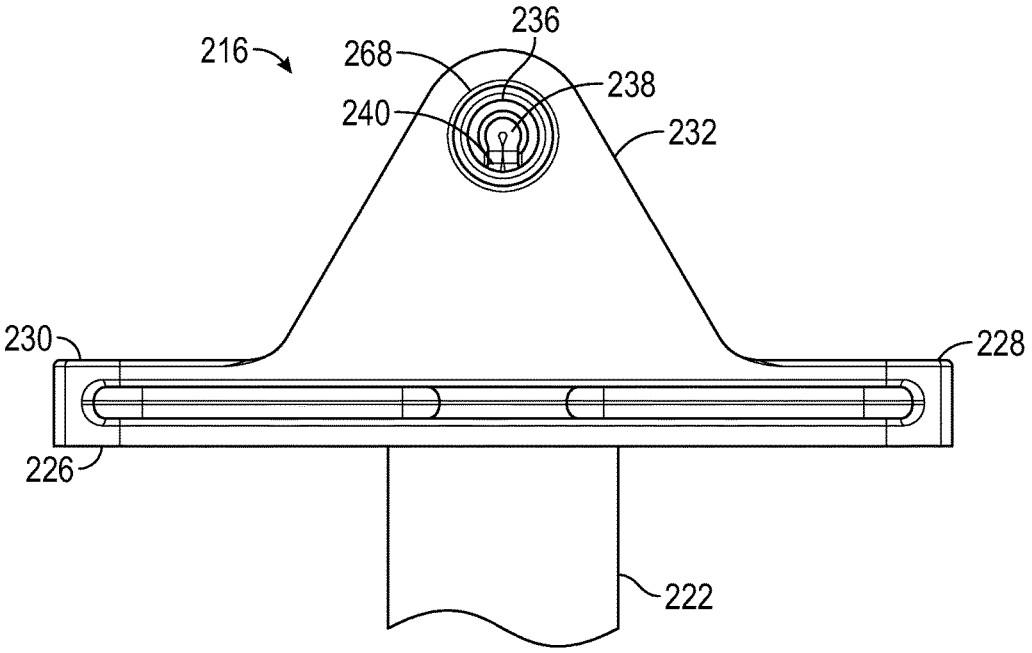
FIG. 9 is a rear elevation view of the nozzle portion of the removable spray head of FIG. 6.

FIG. 8 is a cross-sectional view taken along line 8-8 of FIG. 7, and illustrates the internal structure of the head portion 232 and the air cap 234. With reference to FIGS. 7, 8, and 9, the discharge tube 238 can be positioned in the lumen 236 and supported by a support member 240 such that a longitudinal axis of the discharge tube 238 is coaxially aligned with a longitudinal axis of the lumen 236. As shown in FIGS. 8 and 9, the lumen 236 can at least partially surround the discharge tube 238, apart from the location at which the support member 240 extends from the main body of the head portion 232.

Figure 10:
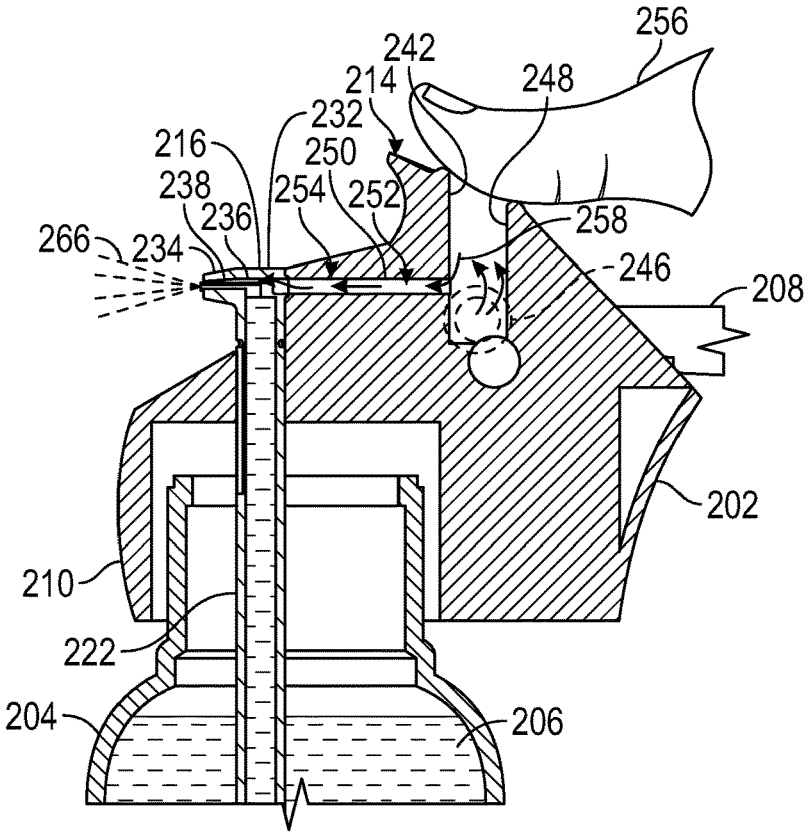
FIG. 10 is a cross-sectional side elevation view of the airbrush body and removable spray head illustrating a flow of compressed gas through the airbrush body and removable spray head to generate a flow of media.
Figure 11:
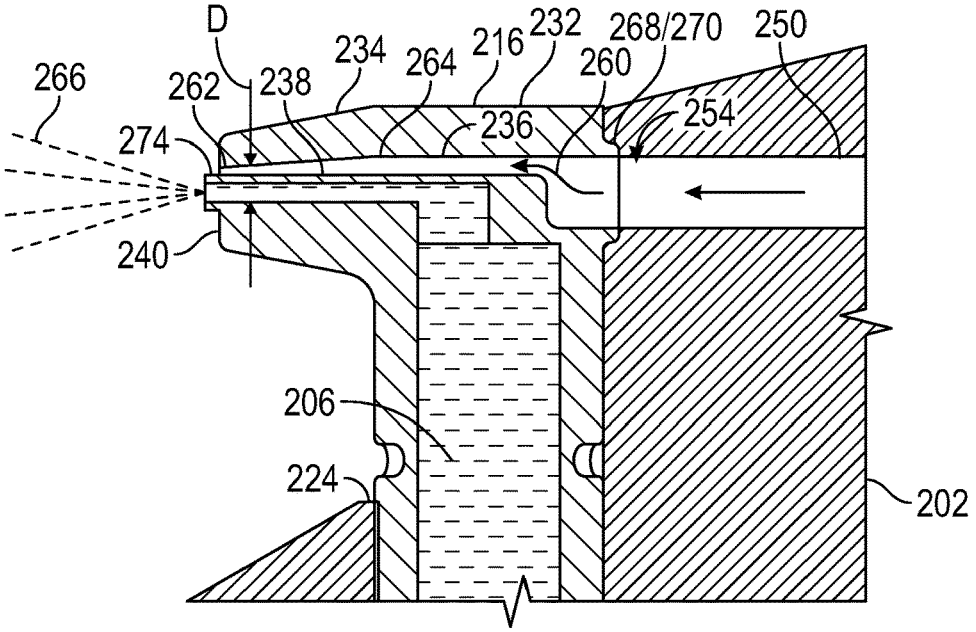
FIG. 11 is a cross-sectional side elevation view of the nozzle portion of the removable spray head illustrating flow of compressed gas around a discharge tube of the removable spray head to generate a flow of media.

FIGS. 10 and 11 are cross-sectional views of the airbrush body 202 and the spray head 216. The airbrush body 202 can define a first passage 242, which can be in communication with an inlet 246 and an outlet 248, similar to the embodiment of FIG. 1. The airbrush body can also define a second passage 250, wherein an inflow end 252 of the second passage is in fluid communication with the first passage 242 and an outflow end 254 of the second passage is in fluid communication with the lumen 236 of the spray head 216. Activation of the trigger portion 214 (by, for example, covering the outlet 248 with a finger 256) can cause compressed gas entering the first passage 242 from the inlet 246 (e.g., from the source 160) to be directed from the first passage into the second passage in the manner indicated by arrows 258. From the second passage 250, the compressed gas can enter the lumen 236 and flow around the support member 240, as indicated by arrow 260 (FIG. 11).

In the illustrated embodiment, the spray head 216 can be retained on the airbrush body 202 by a protruding portion or protuberance 268 defined on a rear surface of the head portion 232. In the embodiment shown, the protuberance 268 can be annular, and can surround the inflow orifice of the lumen 236, as best shown in FIGS. 9, 10, and 11. The protruding portion 268 can be received in a recess 270 defined in an opposing surface of the airbrush body, similar to the embodiment of FIG. 1 above. In the illustrated configuration, the protuberance 268 can coaxially surround the inflow end of the lumen 236, and the recess 270 can coaxially surround the outflow end 254 of the second passage 250. In this manner, engaging the recess 270 with the protuberance 268 can maintain the alignment between the second passage 250 and the lumen 236 during use.

As best shown in FIG. 11, the discharge tube 238 can extend beyond an outlet 262 of the lumen 236. In the illustrated embodiment, the diameter D of the lumen 236 can decrease with decreasing distance from the outlet 262 of the lumen beginning at the location generally indicated at 264. In this manner, the compressed gas can be accelerated toward the outlet 262 of the lumen 238. Upon exiting the outlet 262, the flow of compressed gas around the outlet 274 of the discharge tube 238 can reduce the pressure in the discharge tube in accordance with Bernoulli's Principle. This, in turn, can cause media 206 to be drawn from the reservoir 204 into the media tube 222 and into the discharge tube 238, from which the media can be introduced into the gas flow and atomized as media flow 266 and directed toward a target substrate.

Figure 12:
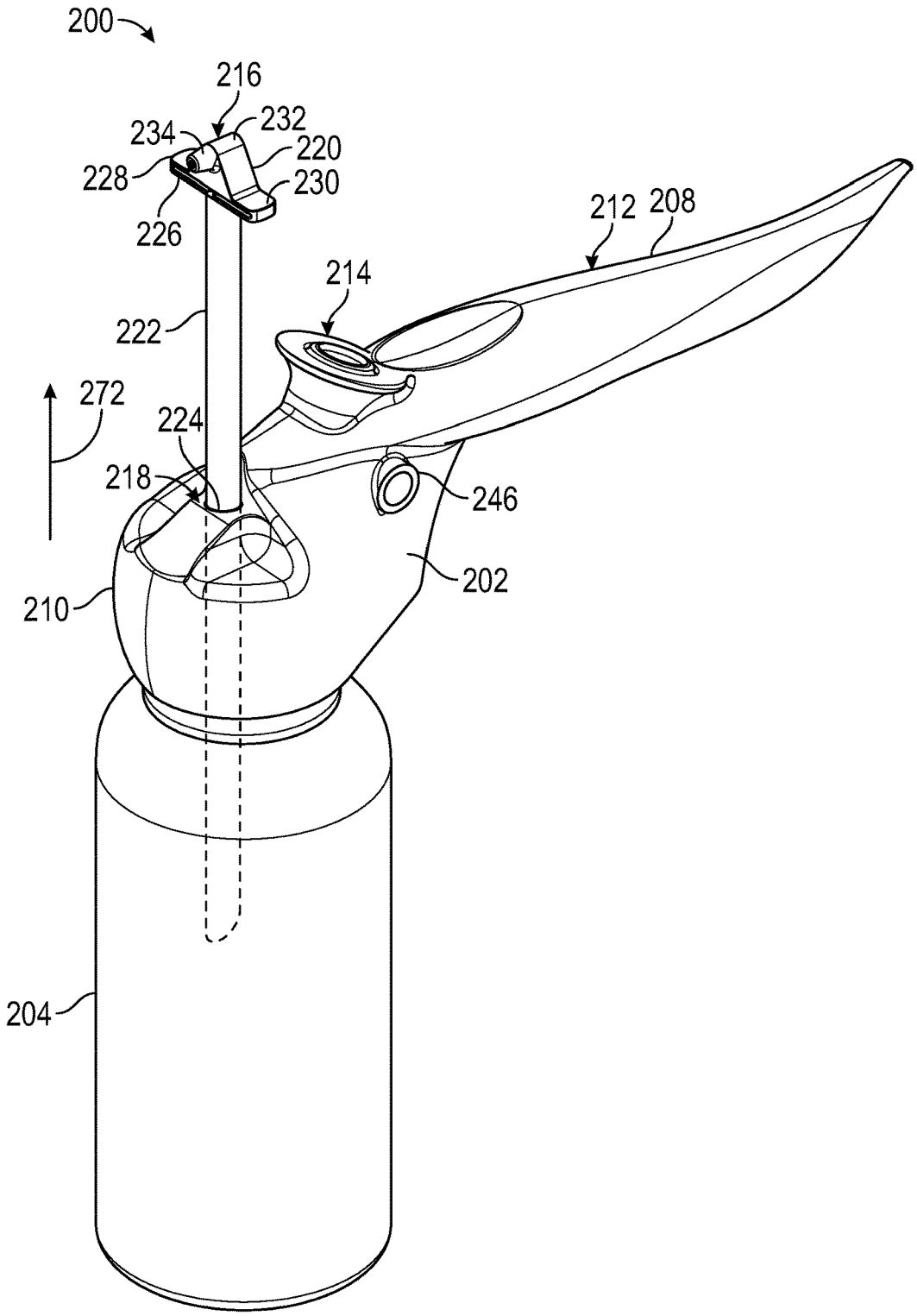
FIG. 12 is a perspective view of the airbrush of FIG. 6 illustrating removal of the removable spray head from the airbrush body.

When a desired amount of media has been applied to the substrate, or if a portion of the spray head 216 becomes clogged, the spray head 216 can be removed from the airbrush body 202 and the media reservoir 204, similar to the embodiment of FIG. 1 above. For example, as illustrated in FIG. 12, a user can grip the tab portions 228, 230 of the base 226 and pull the spray head upwardly in the direction of arrow 272 such that the protuberance 268 disengages from the recess 270 to uncouple the nozzle portion 220 from the mounting portion 218. This allows the media tube 222 to be drawn out of the reservoir 204 through the opening 224 such that the spray head 116 can be carried away without uncoupling the airbrush body from the media reservoir or disconnecting the airbrush body from the pressurized gas source.

The media applicator embodiments described herein can provide a variety of advantages over known media applicator systems. For example, the disclosed embodiments can provide for quick and easy replacement of a spray head without requiring that the airbrush body be detached from the media reservoir, or that the airbrush body be detached from the pressurized gas source. The removable spray head also avoids the need to periodically clean the nozzle portion, as frequently required for media applicators with non-detachable nozzles.

The unitary construction of the nozzle portion and the media tube can also allow the same airbrush body to be used to apply different media (e.g., different media types, colors, etc.) by simply replacing the spray head when changing to a different media color or type, thereby eliminating the need to clean the media applicator. Moreover, the precise configuration of the head portion, the lumen, and the discharge tube as a single unit promotes consistency in the amount of media flow and the degree of media atomization between successive spray heads. For example, the discharge tubes can be precisely located at a predetermined position in the nozzle portions during assembly of the spray heads, and need not require assembly or adjustment by a user in the field. Additionally, the mounting portion of the airbrush body and the protuberance and recess coupling mechanism can help to achieve and maintain a precise alignment between the lumen of the nozzle portion and the passages of the airbrush body between successive spray heads. The spray head embodiments described herein can also promote reduced waste and reduced cost because only the removable spray head, and not the entire airbrush body and/or media reservoir, need be replaced between uses.

Although the trigger portions 114, 214 of the disclosed embodiments are configured as openings that when covered direct a flow of gas through the respective spray heads to produce a flow of media, it should be understood that the trigger portions can have any suitable configuration. For example, in alternative embodiments, the trigger portion can include a valve which can be directly actuated by a user, or indirectly actuated by a lever or linkage. It should also be understood that the spray heads 116, 216 can be used in combination with either of the airbrush bodies 102, 202, as desired.

Figure 13:
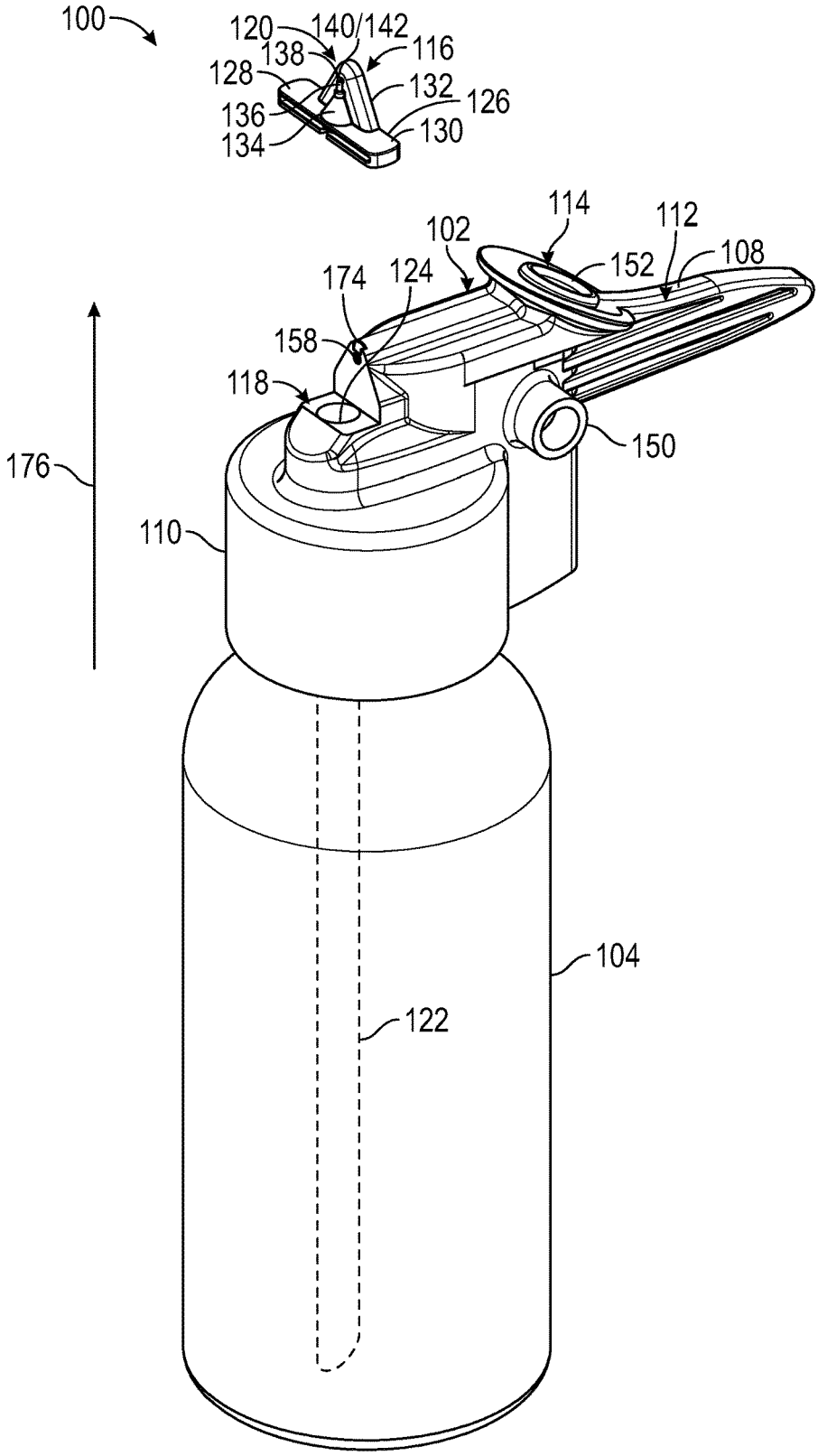
FIG. 13 is a perspective view illustrating another embodiment of the media applicator of FIG. 1 in which the spray head is detachable from the airbrush body while the media tube remains with the airbrush body.

FIG. 13 illustrates another embodiment of the media applicator 100 of FIG. 1 in which the spray head 116 is separable from and attachable to the media tube 122. For example, the media tube 122 can be coupled to and/or integrally formed with the airbrush body 102. When the spray head 116 is coupled to the mounting portion 118, the discharge tube 136 can be in fluid communication with the media tube 122, and the media applicator can be operable as described above. When the spray head 116 is detached from the airbrush body 102, the spray head 116 can be carried away, and the media tube 122 can remain with the airbrush body and the reservoir 104, as shown in FIG. 13. The spray head 216 of FIGS. 6-12 can also be configured in this manner, wherein the spray head 216 is detachable from the airbrush body 202 such that the spray head can be carried away while the media tube 222 remains with the airbrush body.

General Considerations

For purposes of this description, certain aspects, advantages, and novel features of the embodiments of this disclosure are described herein. The disclosed methods, apparatus, and systems should not be construed as being limiting in any way. Instead, the present disclosure is directed toward all novel and nonobvious features and aspects of the various disclosed embodiments, alone and in various combinations and sub-combinations with one another. The methods, apparatus, and systems are not limited to any specific aspect or feature or combination thereof, nor do the disclosed embodiments require that any one or more specific advantages be present or problems be solved.

Although the operations of some of the disclosed embodiments are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods. Additionally, the description sometimes uses terms like "provide" or "achieve" to describe the disclosed methods. These terms are high-level abstractions of the actual operations that are performed. The actual operations that correspond to these terms may vary depending on the particular implementation and are readily discernible by one of ordinary skill in the art.

As used in this application and in the claims, the singular forms "a," "an," and "the" include the plural forms unless the context clearly dictates otherwise. Additionally, the term "includes" means "comprises." Further, the terms "coupled" and "associated" generally mean electrically, electromagnetically, and/or physically (e.g., mechanically or chemically) coupled or linked and does not exclude the presence of intermediate elements between the coupled or associated items absent specific contrary language.

In some examples, values, procedures, or apparatus may be referred to as "lowest," "best," "minimum," or the like. It will be appreciated that such descriptions are intended to indicate that a selection among many alternatives can be made, and such selections need not be better, smaller, or otherwise preferable to other selections.

In the following description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

In view of the many possible embodiments to which the principles of the disclosed technology may be applied, it should be recognized that the illustrated embodiments are only preferred examples and should not be taken as limiting the scope of the disclosure. Rather, the scope of the disclosure is defined by the following claims.

What is claimed is:

1. A media applicator, comprising:

an airbrush body couplable to a media reservoir and defining a first passage for conducting a pressurized gas;

a spray head couplable to the airbrush body, the spray head comprising a nozzle portion in fluid communication with a media tube configured to extend into a media reservoir when the airbrush body is coupled to a media reservoir, the nozzle portion defining a lumen configured to be in fluid communication with the first passage when the spray head is coupled to the airbrush body, the nozzle portion further including a discharge tube in fluid communication with the media tube and situated such that when the airbrush body is coupled to a media reservoir, pressurized gas flow from the first passage through the lumen draws a media contained in the media reservoir through the media tube into the discharge tube, and from the discharge tube into a flow of pressurized gas exiting the lumen of the nozzle portion;

wherein the spray head is detachable from the airbrush body by pulling the spray head in a direction along a longitudinal axis of the media tube to allow the portion spray head to be carried away from the airbrush body.

2. The media applicator of claim 1, wherein an outlet of the discharge tube is located adjacent and at an angle to an outlet of the lumen of the nozzle portion.

3. The media applicator of claim 2, wherein the outlet of the discharge tube is perpendicular to the outlet of the lumen of the nozzle portion.

4. The media applicator of claim 1, wherein the discharge tube is coaxial with the lumen of the nozzle portion.

5. A media applicator, comprising:

an airbrush body couplable to a media reservoir and defining a first passage for conducting a pressurized gas;

a spray head couplable to the airbrush body, the spray head comprising a nozzle portion in fluid communication with a media tube configured to extend into a media reservoir when the airbrush body is coupled to a media reservoir, the nozzle portion defining a lumen configured to be in fluid communication with the first passage when the spray head is coupled to the airbrush body, the nozzle portion further including a discharge tube in fluid communication with the media tube and situated such that when the airbrush body is coupled to a media reservoir, pressurized gas flow from the first passage through the lumen draws a media contained in the media reservoir through the media tube into the discharge tube, and from the discharge tube into a flow of pressurized gas exiting the lumen of the nozzle portion;

wherein the spray head is detachable from the airbrush body to allow the spray head to be carried away from the airbrush body without detaching the airbrush body from the media reservoir; and wherein the media tube is integrally formed with the spray head such that the media tube is carried away with the spray head when the spray head is detached from the airbrush body.

6. The media applicator of claim 1, wherein:

the airbrush body comprises a mounting portion having a surface configured to receive the spray head, the surface being perpendicular to the longitudinal axis of the media tube; and the surface of the mounting portion defines an opening configured to receive the media tube.

7. The media applicator of claim 1, wherein the nozzle portion of the spray head comprises a base portion and a head portion, the lumen of the nozzle portion being defined by the head portion.

8. The media applicator of claim 7, wherein the discharge tube is adjacent an outlet of the lumen and offset from the outlet of the lumen in a direction of flow of pressurized gas exiting the lumen.

9. The media applicator of claim 7, wherein the discharge tube is at least partially located within the lumen of the nozzle portion.

10. The media applicator of claim 9, wherein a diameter of the lumen decreases in a direction toward an outlet of the lumen.

11. The media applicator of claim 7, wherein the base portion comprises at least one tab portion extending radially outwardly relative to the longitudinal axis of the media tube and configured to be gripped by a user.

12. The media applicator of claim 1, wherein the spray head comprises a coupling mechanism to secure the spray head to the airbrush body when the spray head is coupled to the airbrush body.

13. The media applicator of claim 12, wherein the coupling mechanism comprises a protuberance defined on the spray head and configured to be received in a corresponding recess defined in the airbrush body.

14. The media applicator of claim 1, wherein the media applicator is configured to discharge a liquid media or a dry media.

15. The media applicator of claim 1, further comprising a second passage intermediate the first passage and the lumen of the nozzle portion of the spray head.

16. The media applicator of claim 1, wherein the airbrush body further comprises an inlet port in fluid communication with the first passage, the inlet port being connectable to a source of pressurized gas.

17. The media applicator of claim 1, wherein the airbrush body further comprises a trigger portion.

18. A method, comprising:

coupling a spray head to an airbrush body, the airbrush body being coupled to a media reservoir and defining a first passage for conducting a pressurized gas, the spray head comprising a nozzle portion defining a lumen configured to be in fluid communication with the first passage when the spray head is coupled to the airbrush body, the nozzle portion further including a discharge tube in fluid communication with a media tube extending into the media reservoir, the discharge tube being situated such that pressurized gas flow from the first passage through the lumen draws a media contained in the media reservoir through the media tube into the discharge tube, and from the discharge tube into a flow of pressurized gas exiting the lumen of the nozzle portion, the spray head being detachable from the airbrush body by pulling the spray head in a direction along a longitudinal axis of the media tube to allow the spray head to be carried away from the airbrush body without detaching the airbrush body from the media reservoir; and activating a trigger portion of the airbrush body such that pressurized gas flows from the first passage into the lumen of the nozzle portion and media from the media reservoir is introduced from the discharge tube into a flow of pressurized gas exiting the lumen of the nozzle portion and directed outwardly from the nozzle portion.

19. The method of claim 18, wherein the media tube is integrally formed with the spray head, and coupling the spray head to the airbrush body further comprises inserting the media tube into the media reservoir through an opening defined in the airbrush body, and positioning the nozzle portion on a mounting portion of the airbrush body such that the lumen of the nozzle portion and the first passage are in fluid communication with each other.

20. The method of claim 18, further comprising uncoupling the spray head from the airbrush body by pulling the spray head in a direction along the longitudinal axis of the media tube such that the spray head is carried away from the airbrush body without detaching the airbrush body from the media reservoir.

* * * * *